United States Patent [19]

Yamasaki et al.

[11] Patent Number: 4,576,467

[45] Date of Patent: Mar. 18, 1986

[54] LIQUID DEVELOPING APPARATUS

[75] Inventors: Masahiro Yamasaki, Otsu; Iwao Hirose, Hikone; Masao Fukushima, Echi; Ichiro Yoshida, Shizuoka, all of Japan

[73] Assignee: Dainippon Screen Mfg. Co., Ltd., Kyoto, Japan

[21] Appl. No.: 618,188

[22] Filed: Jun. 7, 1984

[30] Foreign Application Priority Data

Jun. 27, 1983 [JP] Japan ..... 58-116709

[51] Int. Cl.[4] ..... G03G 15/10

[52] U.S. Cl. ..... 355/10; 118/647

[58] Field of Search ..... 355/10; 118/659, 662, 118/638, 647; 355/3 FU

[56] References Cited

U.S. PATENT DOCUMENTS 3,334,613 8/1967 Young ..... 355/10
3,547,076 12/1970 Sakliker .
3,791,345 2/1974 McCutcheon .
4,114,999 9/1978 Kogiso et al. ..... 355/10
4,470,688 9/1984 Inagaki et al. ..... 355/3 FU

FOREIGN PATENT DOCUMENTS 56-14525 4/1981 Japan .
2097295 4/1982 United Kingdom .

*Primary Examiner*—R. L. Moses
*Assistant Examiner*—David Warren
*Attorney, Agent, or Firm*—Brumbaugh, Graves, Donohue & Raymond

[57] ABSTRACT

A liquid developing apparatus used for electrophotography comprising a passage for feeding developing solution which is formed between a main electrode plate and an auxiliary electrode plate facing to each other so that a photosensitive sheet having an electrostatic latent image is developed in the passage, wherein at least a surface of the auxiliary electrode plate facing to the back side of the photosensitive sheet is formed into a roughened surface.

5 Claims, 3 Drawing Figures

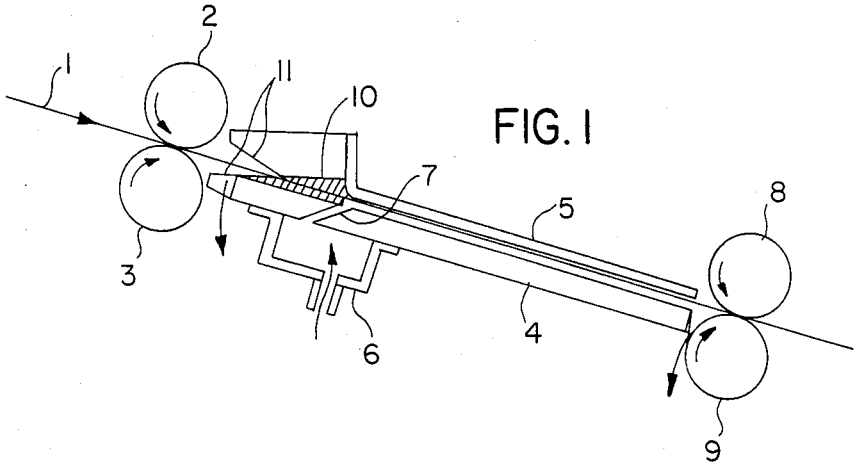
FIG. 1
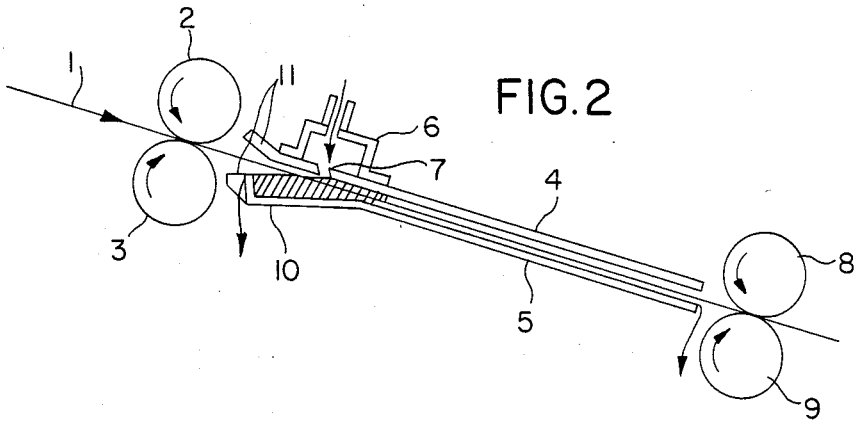
FIG. 2
FIG. 3
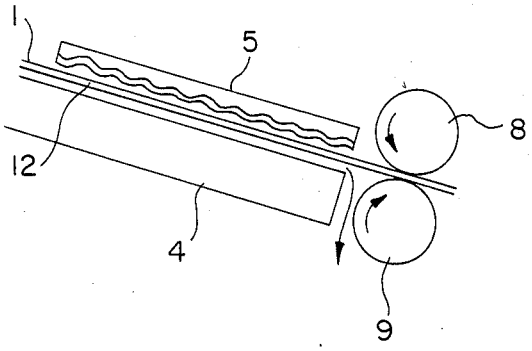

LIQUID DEVELOPING APPARATUS

BACKGROUND AND SUMMARY OF THE INVENTION

This invention relates to a wet developing apparatus for electrophotographic copying machine for the development of electrostatic latent images using a liquid developer.

For the development of electrostatic latent image (hereinafter called as "latent image") formed on a electrophotographic photosensitive sheet (hereinafter called as "photosensitive sheet") using a liquid developing apparatus of some electrophotographic copying machine, it is generally recognised that the following requirements are indispensable to obtain a clear and sharp reproduced image:

(I) The photosensitive sheet is permitted to come nearer to a developing electrode;

(II) Even and adequate developing is obtained on the surface of a latent image;

(III) Back side of the latent image is free from any stain by toner;

(IV) The photosensitive sheet is assured of smooth advance.

With respect to the foregoing requirements, it is usually understood that following points are to be taken into consideration:

(a) When the developing electrode comes nearer to the photosensitive sheet, a resolving power is increased, a high density being obtainable, and a halo i.e. an edge effect peculiar to the electrophotography being decreased;

(b) To obtain even and adequate developing density, it is required not to produce a variation in the local electric characteristics (resistance, for example) caused by inadequate or non-uniformed spacing between the electrodes or by the partial stain, and also required to feed the developing solution uniformly and sufficiently onto the surface of the photosensitive sheet;

(c) To prevent the back side of the photosensitive sheet from being stained by toner and to avoid disordered electric charge on the photosensitive sheet, the back side shall not be put in contact with an auxiliary electrode plate;

(d) To ensure smooth advance of the photosensitive sheet, a guide of low frictional resistance is required.

A number of attempts have been proposed to meet the above-discussed requirements (a), (b), (c) and (d) at a time. Indeed that each of those proposals has its own advantage, but that the requirements for the fair reproduction (a reproduced image of high density, noiseless and high contrast, for example) and for the prevention of the back side from being stained have not been satisfactorily met yet.

According to one example disclosed in U.S. Pat. No. 3,791,545, in order to meet the foregoing requirements (I) through (IV), a developing solution is applied to both sides of the photosensitive sheet, a nylon thread having larger electric resistance than that of the developing solution is stretched facing to the auxiliary electrode plate, and the photosensitive sheet is positioned using the nylon thread as a guide. According to said apparatus, as the phtosensitive sheet is immersed or bathed in the developing solution, the enforcement to be operated to the toner becomes less or reduced, and thus the characteristics proper to the toner and those of the latent image are appropriately represented as it is.

As the result thereof, a relatively successful density, contrast, etc. are obtained and the stain on the back side is not so much. According to said apparatus, however, in order to make a rapid progress of the development, it is necessary to accelerate the polarization in the developing solution thereby the external effect of the electric field of the latent image being increased. Thus it will be essential to use a developer of lower resistance, as the result of which edges of the image are disordered inviting such disadvantages as sagging of edge, mal-reproduction of details. Furthermore, the back side is not completely free from stain because of the existence of gut or nylon thread, and in particular the back side of blackened part is easy to be stained. Besides, in case of using said apparatus over relatively longer period (several weeks), the toner sticks to the contact area between the gut and the auxiliary electrode plate, and it becomes necessary to carry out periodical maintenance service such as cleaning of the auxiliary electrode plate, which is a troublesome work.

According to another example disclosed in Japanese Utility Model Application published under Publication No. Sho 56-14525, an apparatus is proposed having electro-conductive meshes stretched opposite to the auxiliary electrode plate as a guide as well as for positioning, and making use of so-called an effect of electro-conductive mesh. According to an experiment, however, it is found that said effect of electro-conductive mesh has following disadvantages:

(i) When the developing solution is not fed flowing through the back side of the photosensitive sheet, it is difficult to obtain an adequate developing density;

(ii) Back side stain cannot be prevented even by using a fine mesh of about #300, for example;

(iii) Toner sticks to the meshes during the period of repeated uses and the sticked toner can hardly be removed when dried. Particularly at the first copying on each day, the back side is stained by local uneveness of image density and by the physical contact. Furthermore it is quite troublesome to periodically clean the electro-conductive meshes placed on the auxiliary electrode plate.

According to a further example described in U.S. Pat. No. 3,547,076, which makes use of so-called Al effect of electrical field, the developing density is increased by voltage elements which push away the toner to the side of latent image, and the toner stuck to the non-image area on the surface of the photosensitive sheet causing a noise on the back side thereof can be removed or separated therefrom by the voltage elements of reversed polarity. Said apparatus, however, can perform such advantage in a quite limited circumstance or only when the photosensitive sheet applied thereto has an electro-conductive backing of which resistance is sufficiently low. Accordingly, either in case of some photosensitive sheet without such electro-conductive backing and necessary to be charged by means of corona discharge or in case of the other photosensitive sheet of high resistance, the impressed AC electrical field not only increases the developing density on the image surface but also accelerates the sticking of toner to the back side of the latent image, resulting in considerable stain thereof.

It is, therefore, an object of this invention to overcome above-discussed disadvantages by providing a liquid developing apparatus in which the aforementioned requirements (I) through (IV) are satisfied at a time.

Referring to said prior arts, the requirements (I) through (IV) essential to the developement using a liquid developer are further studied in detail hereunder.

Causes which bring about "uneveness" in the developing density on the surface of the photosensitive sheet are classified into two cases. In one case, said unevenness arises in the manner of generating electrostatic force of the latent image caused by the structure of electrode. In another case, said unevenness arises caused by the difference between the densities at the gateway portion where the photosensitive sheet goes in and out when the performance of rendering sufficient density is already declined in the developing solution. In both of these cases, the unevenness in the developing density arises to a serious extent, particularly when the resistance of the auxiliary electrode is high. Perhaps this is because a kind of electrification on the surface of the auxiliary electrode interferes with the progress of development.

In order to prevent the development from such unevenness, following counter-methods are proposed:

(A) To float the photosensitive sheet on the developing solution having strong characteristic of polarization; or (B) To decrease the resistance of the auxiliary electrode and eliminate everything to be electricified.

The former method (A) is disclosed in said U.S. Pat. No. 3,791,345. Said method, however, indispensably needs a developer of lower resistance, thereby being difficult to obtain the sufficient resolving power and the definite edge. Also in case of employing the latter method (B), when the developing solution is not flowed through back side of the photosensitive sheet, the stain by the toner is unavoidable and besides the smooth advance of the photosensitive sheet being negatively affected.

In order to secure even and uniform generation of the electrostatic force of latent image being prevented from the localization thereof, a liquid developing apparatus in accordance with this invention comprises an electrode on which surface some areas to be uniformly stained and some areas having even electro-conductivity are impartially mixed and distributed. Further, in order to secure the smooth advance of the photosensitive sheet, the apparatus in accordance with this invention consists of an electrode in which the contact between the auxiliary electrode and the back side of the photosensitive sheet is uniform in the aspect of point, and said contact being electro-conductive so that the unevenness in the development is prevented.

With respect to the problem that the back side of the photosensitive sheet is stained by the toner, even when the resistance of the auxiliary electrode is decreased or reduced and everything electrifiable is eliminated or removed, the stain arises on the whitened back side of a blackened image of relatively large size, said stain being easily caused particularly when the contact between the photosensitive sheet and the auxiliary electrode is larger in the aspect of face or surface and also when the apparent stain on the auxiliary electrode caused by the developer is larger. This is also perhaps because of the electrification on the surface of the auxiliary electrode. In this case, however, judging from the fact that the front surface of the photosensitive sheet is never stained, said electrification is not so strong as to give influence to the electrostatic force of the latent image on the surface of the photosensitive sheet, and the extent thereof is such that the toner near the electrode is pushed away to the back side of the photosensitive sheet.

Another object of this invention is, therefore, to provide a liquid developing apparatus comprising an electrode in which the contact between the photosensitive sheet and the auxiliary electrode is minimized in the aspect of point so that the back side of the photosensitive sheet is prevented from being stained by toner.

Then with respect to the matter of securing smooth advance of the photosensitive sheet, there are two factors which interfere with said advance. One is a "frictional resistance" of the photosensitive sheet against the auxiliary electrode, and the other is an "electrostatic attraction". Said "frictional resistance" is caused when the contact area is larger between the back side of the photosensitive sheet and the auxiliary electrode. A counter-method thereto is proposed wherein the developing solution is flowed before passing the photosensitive sheet so as to obtain an effect of liquid bearing by the residual developing solution retained on the surface of the auxiliary electrode when passing the photosensitive sheet. According to such method, however, the effect is obtained only at the entrance part of the photosensitive sheet and the frictional contact is unavoidable in the other parts, thus being not so contributional to the smooth advance of the photosensitive sheet.

Further, in order to accelerate said effect of liquid bearing and to minimize the contact area, there is also proposed a so-called "gut method" comprising a gut stretched to the auxiliary electrode (in this case the gut has a different object from the one disclosed by said U.S. Pat. No. 3,791,345). According to this gut method, the advance of the photosensitive sheet is indeed improved, but, except the head portion (or introduction end) of the photosensitive sheet, there arise unavoidably such disadvantages as decrease of developing density, occurence of localization in the developing solution, stain on the back side, etc. depending upon whether the photosensitive sheet touches to the gut or not. There remains a further troublesome problem of cleaning thereof as mentioned above.

With respect to the "electrostatic force" or another factor which interferes with the smooth advance of the photosensitive sheet, when the auxiliary electrode comprises a sufficiently smooth metallic plate for example, a mirror image of the auxiliary electrode comes out or appears as a result of the electrostatic influence of the latent image forming a blackened part of an image. Namely, a mirror image of reversed polarity (the same polarity as the electric charge on the surface of the photosensitive sheet) is produced or generated in the auxiliary electrode, being the mirror image of the electrode for the back side of the blackened area of the image, and accordingly the photosensitive sheet is attracted to the auxiliary electrode, thereby negatively affecting the smooth advance of the photosensitive sheet. Particularly when the developing solution is not flowed on said back side (or flowed just a little), said electrostatic attraction becomes higher and the smooth advance of the photosensitive sheet being fatally interfered therewith.

It is, therefore, a further object of this invention to provide a liquid developing apparatus in which the frictional resistance is decreased and the localization of said electrostatic attraction is prevented by forming the surface of the auxiliary electrode into a uniformly roughened surface so that the effect of liquid bearing is sufficiently performed by the residual developing solution retained on the surface of the auxiliary electrode.

In view of the above-discussed consideration, when the developing solution is not flowed on the auxiliary electrode (or flowed just a little), in order to obtain a sufficient density on the surface of the photosensitive sheet, minimizing the stain in the background of the non-image area on the surface of the photosensitive sheet, and preventing the back side of the photosensitive sheet from being stained, it is indispensably required that the electrification never occurs, that there is no localization in the generation of electrostatic force of the latent image, and that the electrostatic restriction derived from the electric charge of the latent image is not applied to the photosensitive sheet. It is further required to establish such physical condition that the stain by the toner does not interfere with the progress of development and the advance of the photosensitive sheet.

The foregoing requirements are satisfied by the auxiliary electrode of which material and construction are as follows:

(1) The material is of low resistant (not electrified and electro-conductive), less frictional (smooth in advance) and having a mold releasing characteristic (developer-repellent);

(2) Said auxiliary electrode is so formed as to make in contact with the back side of the photosensitive sheet uniformly point by point over the wider range in appearance, and the non-contact area apparently accelerating the effect of liquid bearing.

It is, therefore, a yet further object of this invention to provide a liquid developing apparatus by which the foregoing problems in the prior arts are sufficiently solved and a highly accurate developing process being achieved.

Thus, in accordance with this invention, there is provided a liquid developing apparatus used for electrophotography comprising a passage for feeding a developing solution being formed between a main electrode plate and an auxiliary electrode plate arranged facing to each other so that a photosensitive sheet having an electrostatic latent image therein is developed in said passage, wherein at least a surface of said auxiliary electrode plate facing to the back side of the photosensitive sheet is formed into a roughened surface.

BRIEF DESCRIPTION OF THE DRAWINGS

In the accompanying drawings forming a part of this application, and in which like parts are designated reference numerals throughout the same, FIG. 1 is a sectional side elevation illustrating a preferred embodiment of a liquid developing apparatus in accordance with this invention;

FIG. 2 is a sectional side elevation illustrating another embodiment of a liquid developing apparatus in accordance with this invention; and FIG. 3 is an partially enlarged view of FIG. 1.

DESCRIPTION OF THE PREFERRED EMBODIMENTS

Referring now to the accompanying drawings, some of the preferred embodiments are described hereunder.

In FIGS. 1 and 3, a photosensitive sheet 1 is fed in the direction of arrow by feed rollers 2, 3 and is carried into a developing solution passage formed between a main electrode plate 4 provided with some inclination and an auxiliary electrode plate 5 provided facing to the main electrode plate 4. In this process, before feeding the photosensitive sheet 1, the developing solution is forcedly injected to said passage as an uniform and rectified flow out of a delivery opening or slit-like outlet 7 formed across the carrier way of said photosensitive sheet through the developing solution feeder by means of a pump (not illustrated), and then the developing solution, after filling the passage therewith, being accumulated in a solution sump 10. The photosensitive sheet 1 is carried through the passage with its latent image side facing to the main electrode plate 4 (with said image side downward), and then carried in the direction of arrow by the feed rollers 2, 3. The head part or introduction end of the photosensitive sheet 1 is advanced at first to said sump 10 by a guide 11 and then to said passage. In this process, the photosensitive sheet 1 is pushed up to the side of the auxiliary electrode plate 5 by the developing solution injected out of the slit-like opening 7, thus being carried along with the auxiliary electrode plate 5.

The developing solution accumulated in said sump 10 flows naturally through between the back side of the photosensitive sheet 1 and the auxiliary electrode plate 5, thereby a greater part thereof being consumed. In this process, as an irregular surface 12 coated with a fluororesin film including electro-conductive component is formed on the surface of said auxiliary electrode plate 5 as shown in FIG. 3, the developing solution flowing naturally performs an effect of liquid bearing reducing almost to zero the frictional resistance between the irregular surface 12 and the back side of the photosensitive sheet 1, thereby smooth advance of the photosensitive sheet being accelerated. Meanwhile, the latent image of the photosensitive sheet 1 comes to be a visible image by the toner included in the developing solution forcedly injected, and is delivered out of the developing apparatus by rollers 8, 9. The function and the operation of another embodiment shown in FIG. 2 are almost the same as the foregoing first embodiment, although this another embodiment is used when the photosensitive sheet 1 is carried with its latent image side upward.

With respect to the formation of the auxiliary electrode plate 5, the surface thereof facing to the side of said passage is so formed as to be roughened and in the working process thereof such roughening method as shot blasting, blasting or any other method can be employed including chemical etching, electrolytic oxidation or the like. In this respect, a surface roughness having larger irregularities (from #10 to #60 for example) is preferred in view of the smooth advance of the photosensitive sheet. The fluororesin film coating the auxiliary electrode plate 5 is generally called as "Teflon" or "fluoride". Said resin is ground into powder, surface treatment being applied thereto, the surface treated resin being dispersed in a plating bath which includes electro-conductive metal ions, and said roughened surface being coated with the resin by means of electroplating. The preferred thickness of said fluororesin film may be in the range of $10\mu$ through $15\mu$. The thickness, however, is not limited thereto, because it is controllable depending upon the conditions of electoplating. Cooper or nickle is preferred as for said electroconductive component. Said component, however, is not limited to the above metals so far as it is of non-electrified material and having such content sufficiently. From the practical point of view, the suffcient resistance of said film is in the range of $10^1$ through $10^4\Omega$/cm, and the more preferred resistance is approximately $10^2\Omega$/cm.

In this manner, by coating the roughened surface with said fluororesin, the concave portions being smoothed, and the oil-repellency effect peculiar to the fluororesin as well as the liquid bearing effect of the developing solution retained in the concave portions of the roughened surface synegetically accelerate the smooth advance of the photosensitive sheet 1 and assure that the sticked toner is easily wiped off. Furthermore, when the back side of the photosensitive sheet 1 is carried in contact with the surface of the auxiliary electrode plate 5, there is no turbulence in the electric charge of the photosensitive sheet 1 because of appropriate electric resistance thereto resulting in the obtaining of an adequate image density. Besides, the toner hardly sticks to said fluororesin film because of appropriate insulation and oil-repellency resulting in the successful prevention of the back side of the photosensitive sheet 1 from being stained.

In the foregoing description, one example or mode is described wherein the developing solution flows down to the lower part through between the auxiliary electrode plate 5 and the photosensitive sheet 1. It is, however, not always necessary for the liquid developing apparatus embodying this invention to have such flow down. The apparatus in accordance with this invention is sufficiently practical in the course of an ordinary passage of the developing solution.

Also in the foregoing embodiment, the auxiliary electrode plate is roughened and coated with the fluororesin film including some electro-conductive component. In this respect, it has been found out by experiments that the accuracy in the development using prior apparatus is improved to a certain extent but less than the foregoing emhodiments, by employing such formations as follows:

(a) an apparatus wherein well-sliding and fine irregularities are provided on the surface of the electro-conductive auxiliary electrode, and in which the contact density between said irregularities and the back side of the photosensitive sheet is minimized;

(b) an apparatus wherein a metallic powder treated using some fluororesin electro-conductive material is applied to the surface of the electro-conductive auxiliary electrode plate by means of coating or spraying;

(c) an apparatus wherein the electro-conductive auxiliary electrode plate is roughened by the known method to be a electro-conductive metallic plate, into the surface of which some fluororesin material is embedded or to which a a scraping treatment is applied;

(d) an apparatus wherein a number of fine yarns treated by the electro-conductive fluororesin material are stretched nearby the opposed side of the auxiliary electrode plate;

(e) an apparatus wherein the auxiliary electrode plate comprises fine fibers.

The same level of advantages as above apparatus are also obtained by an apparatus wherein each of the foregoing formations are applied with respect to the main electrode plate in place of the auxiliary electrode plate. In such case, the developing solution forcedly flowing forms a layer of turbulent flow nearby the main electrode plate because of the irregularities, thereby the photosensitive sheet being prevented from coming into contact with said electrode plate.

As many apparently widely different embodiments of this invention may be made without departing from the spirit and scope thereof, it is to be understood that this invention is not limited to the specific example thereof except as defined in the appended claims.

What is claimed is:

1. A liquid developing apparatus designed for electrophotography comprising a main electrode and an auxiliary electrode whose opposed surfaces define a passage for a photosensitive sheet having a latent image on its front surface which is to be developed by contact with a developing solution liquid, means for passing the photosensitive sheet through the passage with its front surface proximate the main electrode, means for filling the passage with liquid and characterized in that the surface of at least one of the electrodes defining the passage is rough and coated with a resin film containing an electroconductive component.

2. The apparatus of claim 1 in which the surface of the auxiliary electrode is rough.

3. The apparatus of claim 1 in which the thickness of the resin film is no greater than 50 microns.

4. The apparatus of claim 1 in which the resistivity of the resin film is no greater than $10^4$ ohm/cm.

5. The apparatus of claim 1 in which the liquid supports the sheet whereby the sheet does not contact either the main or auxiliary electrode in the passage.

* * * * *